United States Patent [19]

Doak

[11] 4,429,525

[45] Feb. 7, 1984

[54] REPAIRING A ROLLER CHAIN

[76] Inventor: Ron K. Doak, 15021 Kimberley La., Houston, Tex. 77079

[21] Appl. No.: 352,493

[22] Filed: Feb. 25, 1982

[51] Int. Cl.[3] ..... B21L 21/00

[52] U.S. Cl. ..... 59/7

[58] Field of Search ..... 59/7, 11, 4

[56] References Cited

U.S. PATENT DOCUMENTS

| | | | |
|---|---|---|---|
| 2,332,607 | 10/1943 | Schroeder | 59/7 |
| 2,361,971 | 11/1944 | Shipman | 59/7 |
| 2,382,447 | 8/1945 | Schaeufele | 59/7 |
| 2,440,512 | 4/1948 | Jakoubek | 59/7 |
| 2,895,289 | 7/1959 | Wognum | 59/7 |
| 3,364,674 | 1/1968 | Banker | 59/7 |
| 3,379,005 | 4/1968 | Jones | 59/7 |
| 4,030,286 | 6/1977 | Gibilaro | 59/7 |

*Primary Examiner*—Gene P. Crosby

*Attorney, Agent, or Firm*—Michael P. Breston

[57] ABSTRACT

A device is disclosed for connecting and disconnecting links in a multi-strand roller chain by exerting on the roller link plates discrete, laterally-spaced, longitudinal forces in one direction on a first row of roller links, and simultaneously exerting equal forces but in an opposite direction on a longitudinally-spaced apart second row of roller links, thereby relaxing the intervening chain links disposed between the first and second rows of roller links which are being drawn together by the application of the equal but opposite forces. The apparatus includes yokes having a first and a second two-prong fork operable for the prongs to become mounted transversely on both sides of the pin plates, at their narrow waists, and to bear against the rounded heads of their adjacent, interconnecting roller plates. The prongs have end portions which project outwardly of both sides of the chain. The apparatus further includes a four-jaw vise for pulling the forks of each yoke toward each other to relax the links of the chain located between the yokes.

7 Claims, 12 Drawing Figures

FIG. 1.
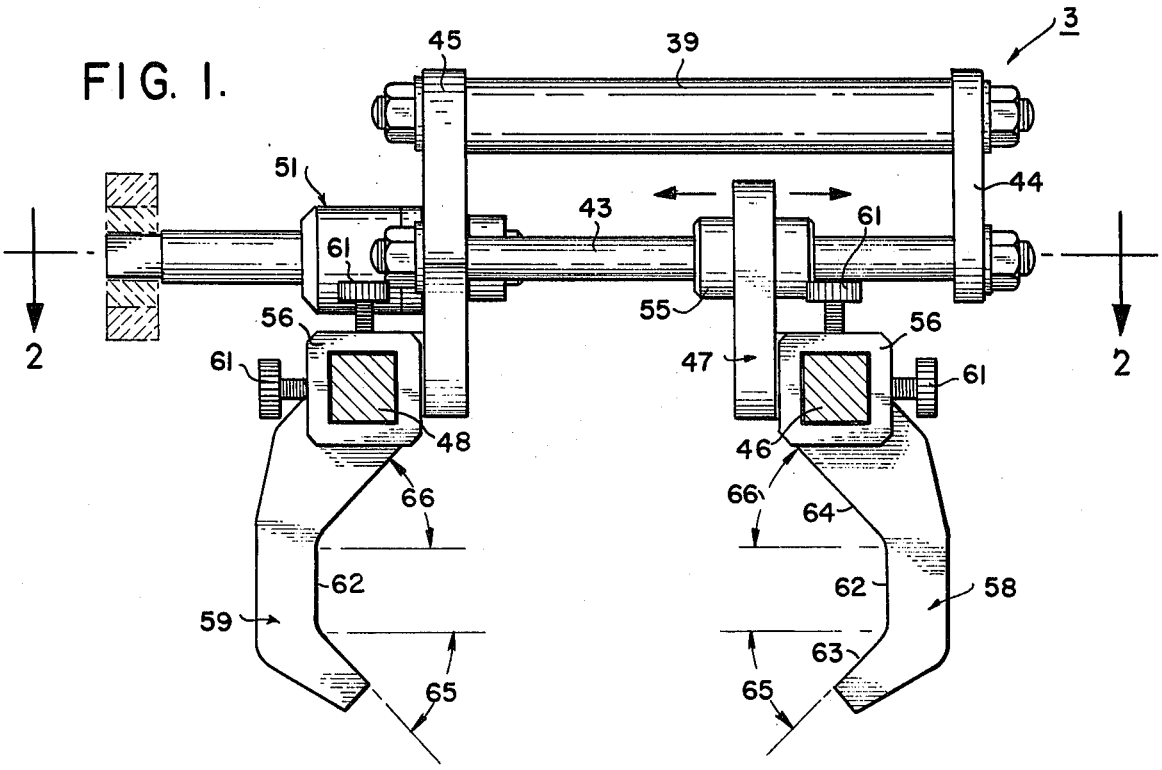
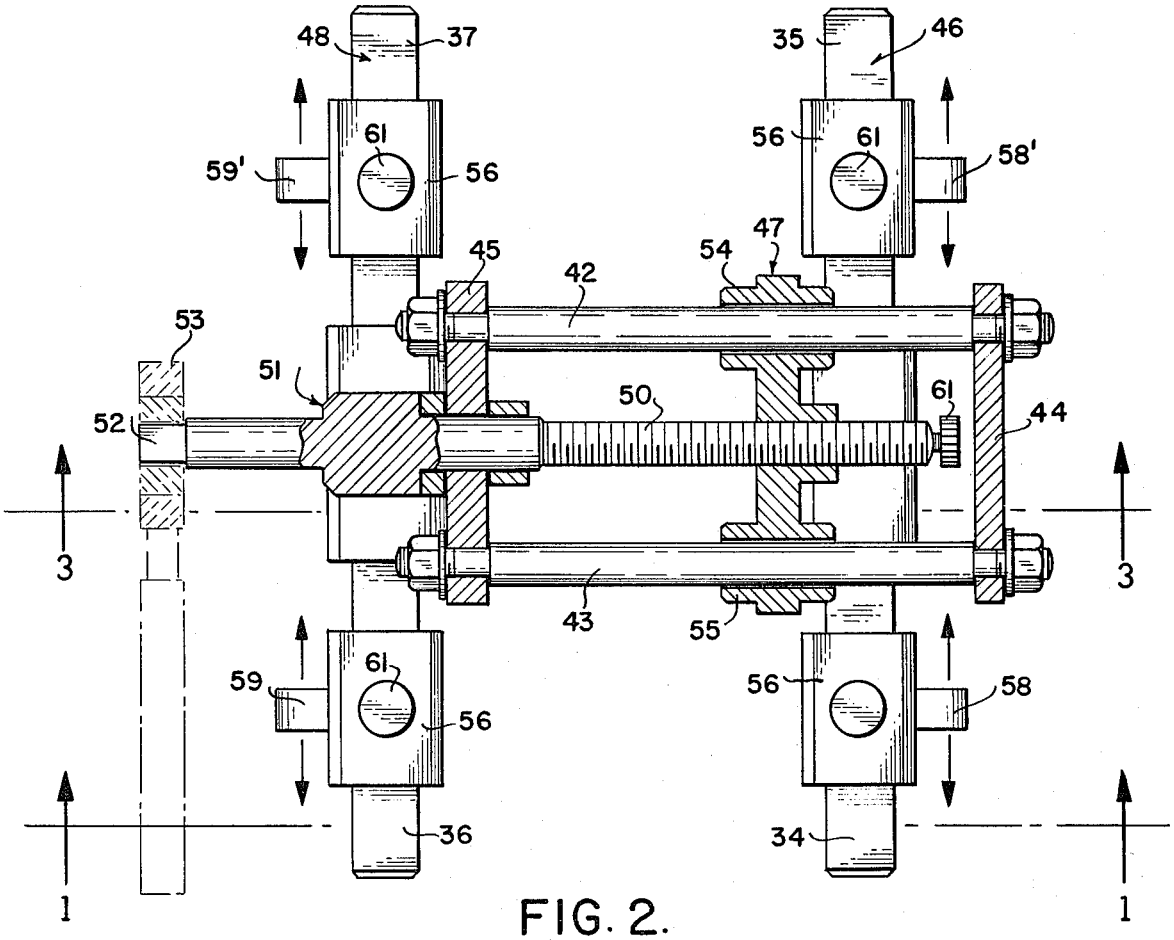
FIG. 2.

FIG. 9.
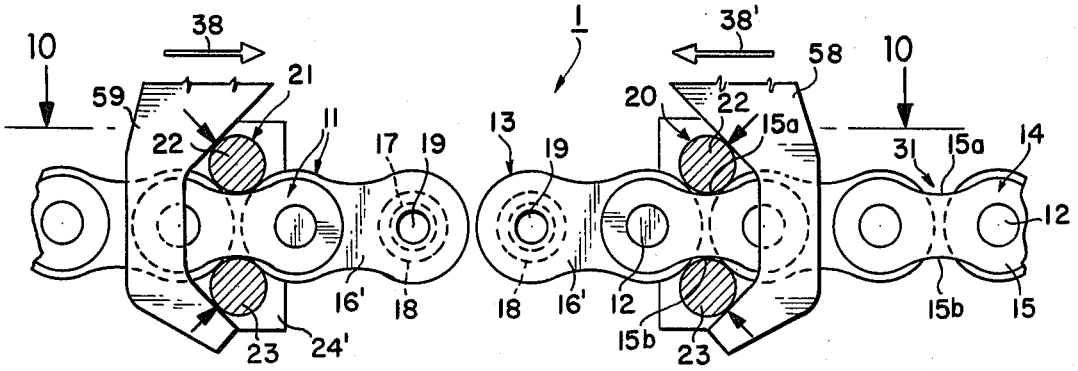
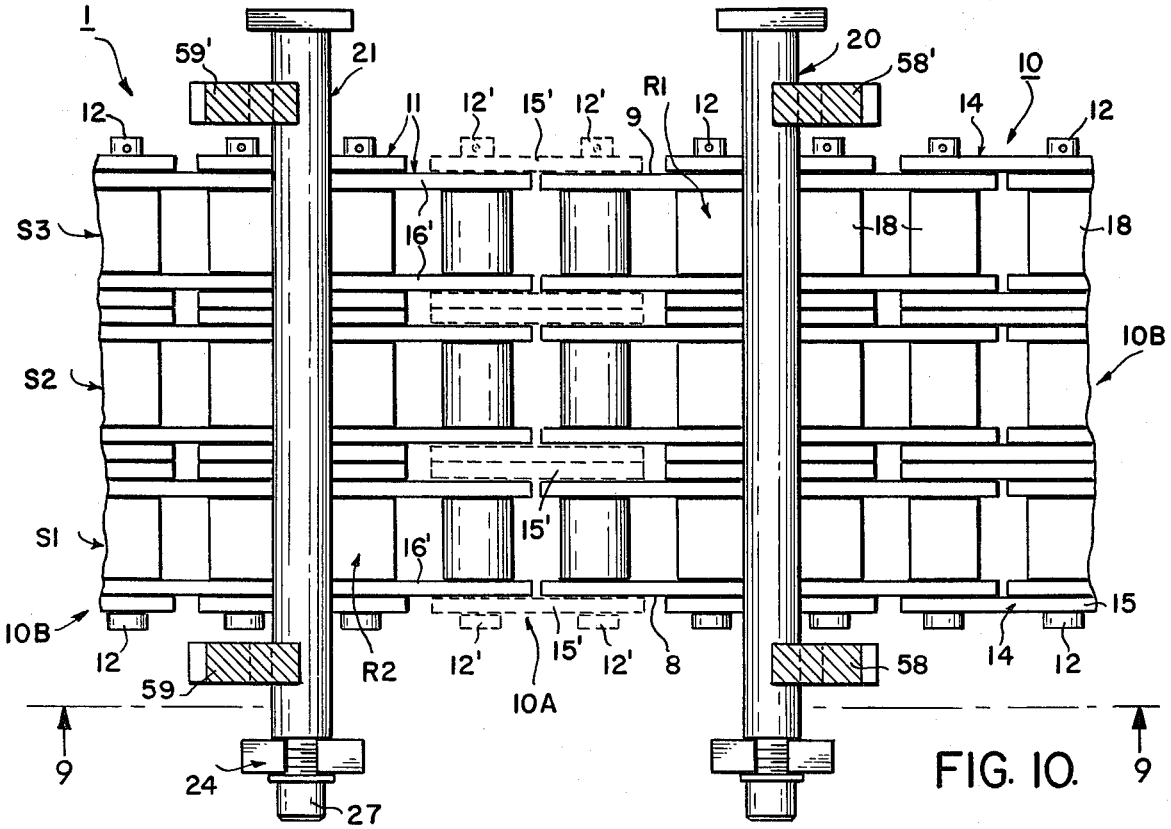
FIG. 10.
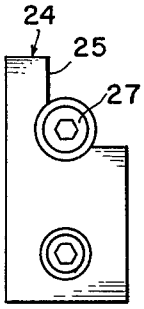
FIG. 12.
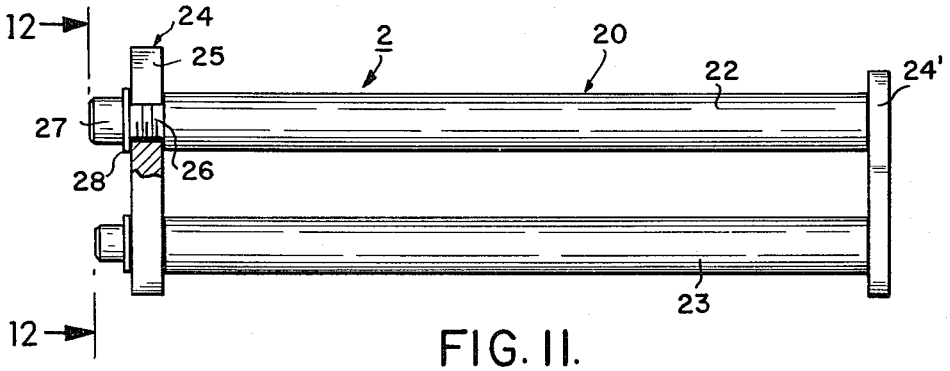
FIG. 11.

REPAIRING A ROLLER CHAIN

BACKGROUND OF THE INVENTION

1. Field of the Invention

This invention relates to a method and apparatus for connecting or disconnecting one or more links in a roller chain having a single or a multitude of strands.

2. Description of the Prior Art

Typically, oil field sprocket roller chains have multi-strands with a single pin extending transversely of the strands. Such chains are mostly used in connection with heavy-duty equipments, such as oil well rigging and the like. Such heavy-duty applications frequently cause severe wear on the more delicate parts of the chains. To provide the chains with longer operating life, and at the same time minimizing the down time for the equipments using such chains, it is good practice to replace as soon as possible those parts which start to show wear.

To assemble or disassemble such a heavy-duty chain in a well-equipped shop can be done with special purpose jigs, but to accomplish the same job in the field while the chain is mounted on the sprockets to which only limited access is frequently available, can become a most difficult and time-consuming task which requires several workers to maintain the parts of the chain aligned before the pins can be inserted therethrough. This task is now frequently being carried out manually or with the aid of crude tooling.

Attempts have been made to provide power tools for connecting and disconnecting a link in a sprocket roller chain, but the known tools have been found to be bulky, cumbersome, and likely to inflict damage to the delicate parts of the chain. Examples of such tooling can be found in the patent literature, for example, see U.S. Pat. Nos. 2,361,971, 3,364,674, 4,030,286, 3,379,005 and 2,895,289.

In U.S. Pat. No. 2,361,971 is described a chain repair tool adapted for single-strand sprocket roller chains. This tool includes a pair of separable jaws capable of engaging the rollers of a pair of longitudinally-spaced roller links. A screw shaft draws together the pair of jaws, thereby relaxing the intervening links between the jaws upon rotation of the shaft. Since the jaws hook onto the rollers of the roller links, when pulling forces become exerted as a result of the jaws being drawn together by manipulating the screw shaft, the hooked rollers and the bushings supporting these rollers quite frequently become damaged.

A somewhat similar tool is also described in U.S. Pat. No. 3,379,005 from which similar damaging results can be expected. Even at best, such tooling is adapted for single strand chains.

In view of the above, there is a great need for a method and tooling for repairing multi-strand sprocket roller chains without, in the process of repairing, introducing damage to the delicate components of such chains, such as the rollers and their bushings. It is further desired that such tooling require a minimum of hand labor.

SUMMARY OF THE INVENTION

In one aspect of the present invention, the problems pertaining to the known prior art tooling, as set forth above, are advantageously avoided. This is accomplished by providing a method for connecting or disconnecting a link or a row of links in a multi-strand roller chain which includes exerting on the roller link plates discrete, laterally-spaced, longitudinal forces in one direction on a first row of roller links, and simultaneously exerting equal forces but in an opposite direction on a longitudinally-spaced apart second row of roller links, thereby relaxing the intervening chain links disposed between the first and second rows of roller links which are being drawn together by the application of the equal but opposite forces.

In another aspect of the present invention, the tooling for disconnecting or connecting a link or a row of links within a sprocket roller chain includes a yoke having a first and a second two-prong fork operable for the prongs to become mounted transversely on both sides of the pin plates, at their narrow waists, and to bear against the rounded heads of their adjacent, interconnecting roller plates. The two prongs in each fork are parallel to each other and to the pins in the chain. The prongs have end portions which project outwardly of both sides of the chain.

The tooling further includes a four-jaw vise having a frame which is adapted to straddle on top of the chain with a pair of longitudinally-opposed jaws facing each other and extending downwardly on each side of the chain. One pair of laterally-spaced jaws is fixedly secured to a traveling block which is threadedly mounted on a screw shaft. The other pair of laterally-spaced jaws can be stationary. The movable, laterally-spaced jaws engage the end portions of the first fork which project outwardly of both sides of the chain. The stationary, laterally-spaced jaws engage the end portions of the second fork which project outwardly of both sides of the chain. By applying a power torque to the screw shaft, the traveling block will move its laterally-spaced jaws toward their opposite, stationary, laterally-spaced jaws. In so doing, the four prongs will bear against the rounded head portions of the engage roller plates engaged, thereby tensioning the portion of the chain not between the jaws and effectively relaxing the portion of the chain between the jaws.

BRIEF DESCRIPTION OF THE DRAWINGS

FIG. 1 is a sectional view, taken on line 1—1 of FIG. 2, of the four-jaw vise used to apply tensioning forces on the yokes;

FIG. 2 is a partly sectional view taken on line 2—2 of FIG. 1;

FIG. 9 is a sectional view taken on line 9—9 of FIG. 10, and also is a partial side view of the vise with the pair of longitudinally-opposed jaws of FIG. 3 shown engaging the end portions of the yokes;

FIG. 10 is a top view of the chain and forks taken on line 10—10 of FIG. 9;

FIG. 11 is a side view of a double-prong fork; and

FIG. 12 is a front view of the fork taken on line 12—12 of FIG. 11.

DETAILED DESCRIPTION OF A PREFERRED EMBODIMENT

Figure 3:
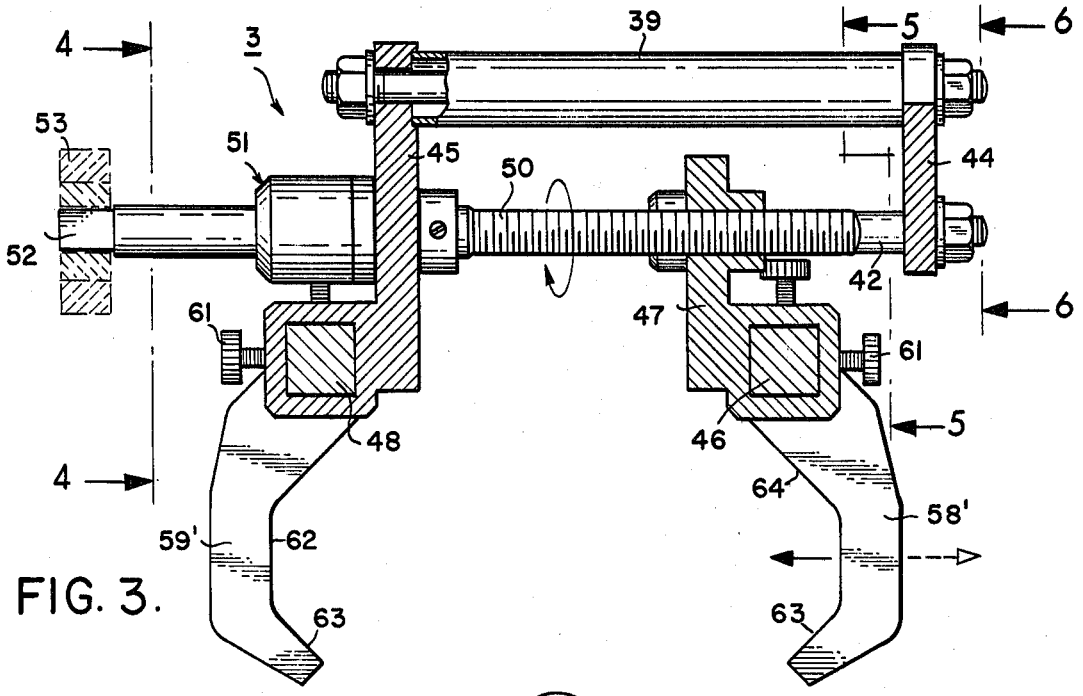
FIG. 3 is a sectional view taken on line 3—3 of FIG. 2.
Figure 4:
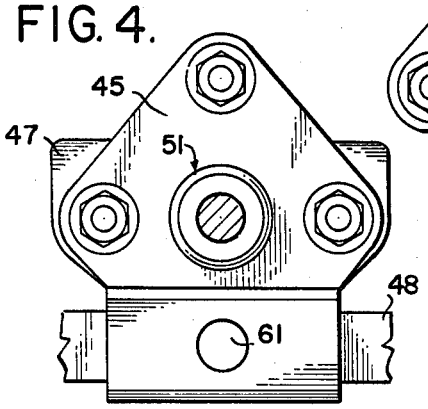
FIG. 4 is a partial front view taken on line 4—4 of FIG. 3.
Figure 6:
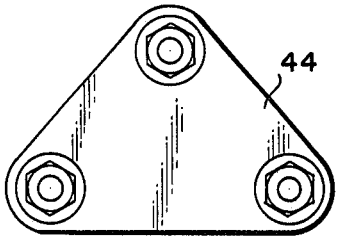
FIG. 6 is a back view taken on line 6—6 of FIG. 3.
Figure 5:
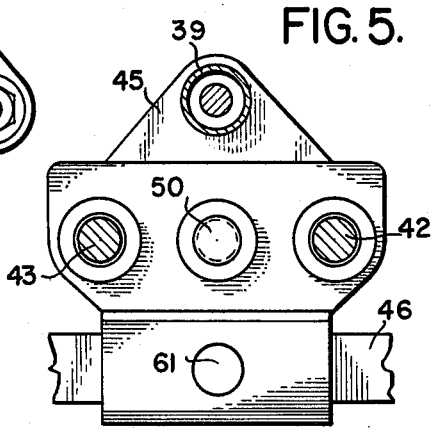
FIG. 5 is a partial back view taken on line 5—5 of FIG. 3.

Throughout the drawings the same numerals will be used to designate the same or similar parts whenever possible to facilitate the description.

Referring first to FIGS. 9–12, there is shown a portion of a typical, well-known, endless sprocket roller chain 10 having opposite sides 8 and 9. Chain 10 comprises a plurality of overlapping, pivotally-interconnected, link pairs 11 which are interconnected by a plurality of pins 12 extending through holes 19. Each link pair 11 includes a roller link 13 interconnected through pin 12 with a pin link 14. A pin link 14 consists of two laterally-spaced pin plates 15 having holes 19 through which extend two pins 12. A roller link 13 consists of two roller plates 16 having two press-fitted bushings 17 therebetween. Bushings 17 have bores 19 through which extend pins 12. A freely rotating roller 18 is mounted over each bushing 17.

In assembled form, chain 10 is thusly made up of alternating roller links 13 and pin links 14. Pins 12 pass through the aligned holes and bores 19 and provide pivots for the roller links 13. The roller plates 16 are free to pivot relative to the pin plates 15. As the chain flexes, turning occurs only relative to the pins 12. The bushings 17 are secured to their respective roller plates 16. A pin plate 15 has a pair of opposed concave side portions or waists 15*a*, 15*b*, and a roller plate 16 has a pair of opposed rounded heads 16*a*.

The plates 15 and 16 are primarily tension members. The rollers 18 act as shock absorbers to reduce the effects of impact as the chain engages the sprockets (not shown) of the heavy-duty equipment operated by chain 10. The rollers 18 also provide rolling engagement with the sprocket piece.

It has been found that in use the bushings 17 and rollers 18 riding thereon are subject to great wear and require frequent replacement. Since chain 10 is connected in endless fashion, to replace its worn out parts it is first necessary to remove a designated pin link, or a row of pin links consisting of a pair of pins 12' and a row of pairs of plates 15'. In order to remove pins 12', it is first necessary to relax the particular link pairs 11 which include the particular pins 12' desired to be removed. Then, to reconnect the chain in endless fashion after the worn out parts are replaced with new parts, first the holes 19 in plates 15' and 16' are aligned and the removed or new pins 12 are inserted through the aligned holes 19.

The assembly or disassembly of an endless sprocket roller chain becomes even more complicated when the chain comprises more than one strand. In FIG. 10, chain 10 is shown as having three individual strands S1, S2, S3. Basically, such a chain consists of three strands of laterally-aligned link pairs 11 having a single pin 12 transversely extending therethrough. It will be appreciated that the alignment of the bores 19 in the pin and roller plates 15 and 16 in a multi-strand chain can be very time consuming if carried out by hand or with inefficient tooling. In addition, it is important that the employed tooling respects the integrity of the delicate parts of the chain while applying stresses to the chain. It is undesirable that such tooling exert tension forces onto the chain by way of the rollers 18, since such rollers as well as the bushings supporting them have not been designed to transfer large tensile stresses.

In accordance with the invention for assembling or disassembling a single or a multi-strand chain 10, there is provided an apparatus 1 having a chain-engaging yoke 2 and a four-jaw vise 3. Yoke 2 includes a first fork 2 and a second fork 21. Each fork includes a pair of prongs 22, 23. Each prong has a circular cross section.

To tie the prongs 22, 23 together there are provided on one end a tie plate 24 having an L-shaped channel 25, and on the other end a fixed end plate 24'. One end of each prong is provided with a threaded projection 26 which extends through plate 24 and is secured thereto by a bolt 27 and a washer 28. L-shaped channel 25 allows the tie plate 24 to rotate about prong 23 and to become secured to the prongs 22, 23 after its fork gripplies the chain.

Each fork is operable to become disposed transversely of chain 10 whereby its prongs 22, 23 preferably gripple the opposite waists 15*a*, 15*b* of the row of pin plates 15'. Prongs 22, 23 are lodged in the valleys 31 of the pin plates 15 formed by and between two adjacent roller plates 16 in the assembled chain 10. The diameter of each one of prongs 22, 23 is preferably such that when a prong is nested in a valley 31, it will rest on a waist 15*a* or 15*b* and touch the rounded heads 16*a* of an adjacent pair of roller plates 16. When so dimensioned and disposed on chain 10, the prongs 22, 23 can be made effective by the apparatus 1 to transfer longitudinal forces to the roller plates 16 with which the prongs become clampingly engaged in the vise 3.

Forks 20 and 21 have end portions which project outwardly of the opposed sides 8 and 9 of chain 10. To disassemble for example a multi-strand chain 10, it is first necessary to remove the desired pins 12' and the pin plates 15', shown in dotted lines in FIG. 10. To this effect, in accordance with the method of this invention, the forks 20 and 21 of yoke 2 are disposed transversely of the chain across the valleys 31 of a pair of longitudinally-spaced apart rows R1 and R2 of pin plates 15. Row R1 is disposed on one side of plates 15' desired to become replaced or removed, and row R2 is disposed on the other side of plates 15'. Vise 3 is made operable so that the distance between forks 20 and 21 of yoke 2 becomes reduced. Such distance reduction requires that forks 20 and 21 are pulled or drawn toward each other while maintaining their parallel relationship, preferably by sufficiently pulling on their opposed, laterally-spaced pairs of prong end portions.

As a result, the chain portion 10A which lies between forks 20 and 21 becomes relaxed, while the chain portion 10B which is outside of the forks becomes taut. When chain portion 10A is relaxed, it then becomes easy to drive out the desired pair of pins 12' from the row of pin plates 15'.

Referring now more particularly to vise 3 (FIGS. 1–6) of this invention, it includes a frame 41 which is designed to clamp its two pairs of longitudinally-spaced, opposed jaws to forks 20, 21, respectively.

Frame 41 has a pair of laterally-spaced, parallel rails 42, 43 and a top beam 39 which also serves as a handle. Members 39, 41 and 43 are rigidly maintained in their respective positions by rigid end plates 44, 45. A first, transverse, elongated bar 46 is secured to the lower end of a traveling block 47. Bar 46 has end portions 34, 35 projecting outwardly and symmetrically of rails 42, 43. A second, transverse, elongated bar 48, identical to and disposed parallel with bar 46, is secured to the fixed plate 45. Bar 48 has end portions 36, 37 also projecting outwardly and symmetrically of rails 42, 43. Bars 46, 48 preferably have a rectangular cross-section and are at the same distance from the plane containing the longitudinal axes of rails 42, 43.

A longitudinally-disposed screw shaft 50 is symmetrically positioned between rails 42, 43. Traveling block 47 is threadedly mounted on shaft 50. The blank end of shaft 50 is secured to a bearing block 51 which is rotatably mounted in the center of plate 45. The outer end 52 of block 51 is adapted to be rotated by a suitable wrench, such as a ratchet wrench 53.

Traveling block 47 has a pair of sleeves 54, 55 which slidably receive therethrough rails 42, 43, respectively. Slidably mounted on the end portions 34, 35 of bar 46 are a pair of jaws 58, 58', respectively. Slidably mounted on the end portions 36, 37 of bar 48 are a pair of jaws 59, 59', respectively. Each jaw has a socket 56 that is securable to its rail by a screw 61.

In one embodiment of the jaw, the hook portion has a vertical surface 62, a downwardly-and-outwardly slanted surface 64 (as viewed in FIG. 1), and a downwardly-and-inwardly slanted surface 63. Surface 63 makes an angle 65 and surface 64 makes an angle 66 with the horizontal. All the jaws are identical and inerchangeable. Longitudinally-spaced jaws 58 and 59 form one pair of opposed and cooperating jaws. Similarly, longitudinally-spaced jaws 58', 59' form a second pair of opposed and cooperating jaws. In each cooperating pair of jaws, the hook surfaces 62–64 are identical and face each other.

It is the purpose of vise 3 to operate on yoke 2 with the aid of the two pairs of longitudinally-spaced, opposed jaws 58–59 and 58'–59' which pull on, and thereby draw together, the prong ends of forks 20 and 21.

In use, after forks 20 and 21 have been mounted on chain 10, as previously described, vise 3 is disposed on top of the chain (FIGS. 9–10) with the opposed pairs of cooperating jaws 58–59 and 58'–59' extending downwardly from the opposite sides 8 and 9 of the chain. Then, the threaded shaft 50 is rotated to allow traveling block 47 to back off sufficiently from end plate 45 to allow ample longitudinal spread between the two pairs of opposed jaws. Thereafter, the threaded shaft 50 is rotated in an opposite direction to allow the two pairs of opposed and cooperating jaws to engage the projecting prong end portions of forks 20 and 21.

Further rotation of shaft 50 will cause the slanted surfaces 63 and 64 to exert pressure forces, in the direction of the arrows, against the prongs engaged thereby, and through these prongs against the rounded heads **16*a* of the roller plates 16 which are engaged by the prongs. The angles 65 and 66 of the slanted surfaces 63, 64, respectively, are selected such that the prongs cannot slide out from the valleys 31 to which they are confined. Continued rotation of threaded shaft 50 will move block 47 toward stationary plate 45. As the distance between block 47 and plate 45 shortens, the desired relaxation takes places of the intervening link pairs 11 in the chain portion 10A** between the jaws.

The jaws exert inwardly directed forces against the prong end portions of forks 20 and 21. As a result, the slanted surfaces 63, 64 of the opposed pair of jaws 58–59, and the slanted surfaces 63, 64 of the opposed pair of jaws 58'–59' forcibly bear against the prong end portions of forks 20 and 21, respectively.

It will be appreciated that the inwardly directed forces, which are exerted by the jaws in the direction of the solid arrows on the prong end portions, create within the chain portion 10B, outside of the jaws, tensile forces in the directions of the hollow arrows 38, 38', within the pin and roller plates 15 and 16. These tensile forces make chain portion 10B taut and chain portion 10A relaxed.

After the desired pins 12' and pin plates 15' are removed, chain 10 is in the position shown in FIG. 9. After the chain is disassembled, it then becomes easy to replace all worn out chain components, as part of a good preventative maintenance procedure. To reassemble the chain, holes 19 in pin plates 15 and in roller plates 16 are aligned and a pair of pins 12 are driven into such holes while the chain portion 10A is maintained in its relaxed condition by pulling forks 20 and 21 toward each other in the direction of the hollow arrows 38 and 38'.

It will be appreciated that while the forks 20 and 21 (FIG. 9) engage the rounded head portions **16*a* of the roller plates 16' from which pins 12' have been removed, these roller plates 16' remain horizontal which makes it easy to align their holes 19**.

Figure 7:
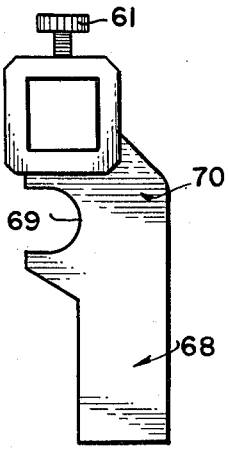
FIG. 7 is a side view of a modified jaw used in the vise of FIG. 1.

In FIG. 7 is shown a modified jaw embodiment, generally designated as 70. This jaw has a semi-cylindrical socket 67 and a vertical shoulder 68 having a rectangular cross section. In all other respects, it is similar in construction to the jaw embodiment shown in FIG. 1.

Figure 8:
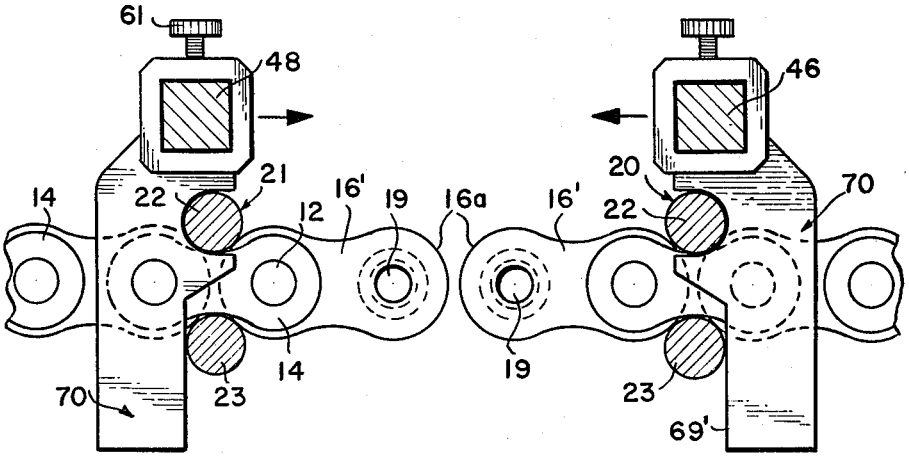
FIG. 8 is a partial side view of the vise with the jaws of FIG. 7 shown engaging the end portions of the yokes.

In FIG. 8 is shown a side view of vise 3 disposed on top of chain 10 with the opposed pairs of cooperating jaws 70 extending downwardly from the opposite sides 8 and 9 of the chain. Each socket 67 engages one prong end, and each flat surface 69' of shoulder 68 engages the other prong end of each fork on each side of the chain. In all other respects, the description previously given relative to FIG. 9 also applies to FIG. 8.

It will also be appreciated that the method and apparatus of the present invention are relatively simple to use, reliable in operation, and lend themselves for use on chains in tight quarters with a minimum of labor. In fact, in most cases vise 3 can be operated by a single chain repairman.

Other advantages will readily become apparent to those skilled in the art and the invention lends itself to modifications all of which are intended to be claimed in the claims attached hereto.

What is claimed is:

1. A method for applying tensioning forces to a roller chain, comprising:

mounting a separate yoke transversely across each one of two longitudinally-spaced portions of said chain for engaging the peripheral edges of the links thereof; and reducing the distance between said yokes to thereby relax the portion of the chain disposed between said yokes.

2. A method for connecting or disconnecting a link or a row of links in a roller chain comprising:

exerting on the periphery of the roller link plates discrete, laterally-spaced, longitudinal forces in one direction on a first row of roller links; and simultaneously exerting equal forces but in an opposite direction on a longitudinally-spaced apart second row of roller links, thereby relaxing the intervening chain links disposed between the first and second rows of roller links which are being drawn together by the application of the equal but opposite forces.

3. A tool for repairing an endless sprocket roller chain having at least one strand of pairs of links, each pair having a roller link, an overlapping pin link, and a transverse pivot pin interlinking the roller link with the pin link; each pin link being associated with a pair of laterally-spaced pin plates, and each roller link being associated with a pair of roller plates and with a roller freely rotatable about said pivot pin, said apparatus comprising:

a first fork for transversely grippling a first pin link of a first pair of links;

a second fork for transversely grippling a second pin link of a second pair of links which is longitudinally spaced from the first pair of links; and power means operable to pull said second fork relative to the first fork, thereby exerting through said forks discrete, tensile forces in the roller plates and in the pin plates of said pairs of links.

4. The apparatus according to claim 3, wherein each fork is a two-pronged fork adapted to become mounted across said chain to gripple between its prongs the pin plates of the pin links.

5. The apparatus according to claim 3, wherein each one of the first and second forks has end portions which extend outwardly of the sides of said chain, said power means is a four-jaw vise adapted to straddle across said chain, and said vise having a pair of opposed jaws on each side of the chain operable to engage the opposing end portions of said first and second forks which extend outwardly of the chain.

6. The apparatus according to claim 3, wherein said forks, when pulled by said power means, bear against the roller links which interlink with said first and second pin links.

7. An apparatus for disconnecting or connecting a link or a row of links within a sprocket roller chain, comprising:

yoke means having a first and a second two-prong fork operable for the prongs to become mounted transversely on both sides of the pin plates of said chain, at their narrow waists, and to bear against the rounded heads of their adjacent, interconnecting roller plates, the two prongs in each fork being parallel to each other and to the pins in the chain, and the prongs having end portions which project outwardly of both sides of the chain; and a four-jaw vise having a frame which is adapted to straddle on top of the chain, said vise having one pair of laterally-spaced jaws fixedly secured to a traveling block which is threadedly mounted on a screw shaft and another stationary pair of laterally-spaced jaws, the movable, laterally-spaced jaws engage the end portions of the first fork which project outwardly of both sides of the chain, and the stationary, laterally-spaced jaws engage the end portions of the second fork which project outwardly of both sides of the chain, whereby movement of the traveling block causes the movable, laterally-spaced jaws to move toward their opposite, stationary, laterally-spaced jaws, thereby tensioning the portion of the chain not between the jaws and effectively relaxing the portion of the chain between the jaws.

* * * * *